US008312864B2

(12) United States Patent
Grossner et al.

(10) Patent No.: US 8,312,864 B2
(45) Date of Patent: Nov. 20, 2012

(54) METHOD AND DEVICE FOR THE VOLUME FLOW CONTROL OF AN INJECTION SYSTEM

(75) Inventors: Thomas Grossner, Neutraubling (DE); Christoph Klesse, Wörth A.D. Donau (DE)

(73) Assignee: Continental Automotive GmbH, Hannover (DE)

( * ) Notice: Subject to any disclaimer, the term of this patent is extended or adjusted under 35 U.S.C. 154(b) by 335 days.

(21) Appl. No.: 12/529,799

(22) PCT Filed: Jan. 29, 2008

(86) PCT No.: PCT/EP2008/051069

§ 371 (c)(1), (2), (4) Date: Sep. 3, 2009

(87) PCT Pub. No.: WO2008/110403

PCT Pub. Date: Sep. 18, 2008

(65) Prior Publication Data

US 2010/0019069 A1 Jan. 28, 2010

(30) Foreign Application Priority Data

Mar. 9, 2007 (DE) ..... 10 2007 011 654

(51) Int. Cl.
*F02M 59/36* (2006.01)
*F02M 37/00* (2006.01)

(52) U.S. Cl. ..... 123/458; 123/514

(58) Field of Classification Search ..... 123/446, 123/447, 510, 511, 514, 457, 458
See application file for complete search history.

(56) References Cited

U.S. PATENT DOCUMENTS

| | | | | |
|---|---|---|---|---|
| 5,313,924 | A * | 5/1994 | Regueiro | 123/456 |
| 5,448,977 | A * | 9/1995 | Smith et al. | 123/478 |
| 5,927,322 | A * | 7/1999 | Rosenau | 137/487.5 |
| 6,349,703 | B1 * | 2/2002 | Rapp | 123/458 |
| 6,408,824 | B1 * | 6/2002 | Pacucci et al. | 123/467 |
| 6,439,190 | B1 * | 8/2002 | Bochum | 123/295 |
| 6,578,553 | B1 * | 6/2003 | Schubert et al. | 123/458 |
| 7,121,264 | B2 * | 10/2006 | Frank et al. | 123/458 |
| 7,207,319 | B2 * | 4/2007 | Utsumi | 123/446 |
| 7,267,106 | B2 * | 9/2007 | Adachi et al. | 123/436 |
| 7,721,712 | B2 * | 5/2010 | Bitter et al. | 123/458 |
| 2006/0042599 | A1 * | 3/2006 | Frank et al. | 123/458 |

FOREIGN PATENT DOCUMENTS

| | | | |
|---|---|---|---|
| DE | 19727785 | A1 | 1/1999 |
| DE | 19757594 | C2 | 7/1999 |
| DE | 10358419 | A1 | 7/2005 |
| DE | 102005022661 | A1 | 2/2007 |
| WO | 03083286 | A1 | 10/2003 |

OTHER PUBLICATIONS

German Office Action, German application No. 10 2007 011 654.5-13, 3 pages, Oct. 10, 2007.
International PCT Search Report, PCT/EP2008/051069, 11 pages, May 21, 2008.

* cited by examiner

*Primary Examiner* — Thomas Moulis
(74) *Attorney, Agent, or Firm* — King & Spalding L.L.P.

(57) ABSTRACT

In a method and a device for the volume flow control of an injection system, a seat valve (3) is used for the volume flow control. For this purpose, the influence of the pressure present upstream of the seat valve (3) is taken into consideration in the volume flow control.

13 Claims, 1 Drawing Sheet

METHOD AND DEVICE FOR THE VOLUME FLOW CONTROL OF AN INJECTION SYSTEM

CROSS-REFERENCE TO RELATED APPLICATIONS

This application is a U.S. National Stage Application of International Application No. PCT/EP2008/051069 Jan. 29, 2008, which designates the United States of America, and claims priority to German Application No. 10 2007 011 654.5 filed Mar. 9, 2007, the contents of which are hereby incorporated by reference in their entirety.

TECHNICAL FIELD

The invention relates to a method and a device for the volume flow control of an injection system according to the features of the preamble of claim 1 or claim 4.

BACKGROUND

Fuel injection devices for operating an internal combustion engine have been known in general for many years. In a common rail injection system, fuel injection takes place in the respective combustion chamber of the internal combustion engine by means of injectors, in particular piezo injectors. Here, the quality of the combustion is dependent upon the pressure in the high pressure storage unit. In order to achieve as high a specific performance of the internal combustion engine as possible and at the same time low emissions of pollutants, the pressure of a high pressure storage unit must be controlled. When using a high pressure pump and a pressure storage unit for the fuel, injection pressures can reach between 1600 and 1800 bar.

Control of the pressure in the high pressure storage unit can be carried out in different ways. Depending on the embodiment of the injection system, this can be achieved with a pressure control valve in the high pressure region and a volume control valve on the low pressure side of the high pressure pump or just with a volume control valve on the low pressure side of the high pressure pump. Only the second case, i.e. pressure control with a volume control valve, is described in detail in the following. Control of the pressure in the high pressure storage unit takes place by controlling the volume flow in the low pressure region of the high pressure pump. This volume flow control is dependent both on system requirements which are determined by the quantity of fuel injected into the combustion chamber and also by the quantity of fuel which exits the injectors by switch leakage losses.

The volume flow control can thereby take place by means of gate valves. These are however not suitable for a volume flow control since they generally experience gap leakage losses via the pistons. These gap leakage losses are larger when the injection system is used in idling mode or in overrun conditions.

In the volume flow control a stop valve such as a ball which is pushed into a seat, completely cuts off the volume throughflow by means of a seat valve and thus prevents gap losses from occuring. In the seat valve, however, the pressure acting on the stop valve has an effect on the required supply of electric current to the valve. In this way, a change in pressure results in the shifting of a recorded valve characteristic curve. In the valve characteristic curve, the required supply of electric current to the valve is recorded dependent on the volume flow to be set.

SUMMARY

According to various embodiments, changes in pressure acting on the stop valve in the valve characteristic curve can be taken into consideration.

According to an embodiment, in a method for the volume flow control by means of a volume flow control unit in an injection system of an injection apparatus of an internal combustion engine depending on the quantity of fuel fed into the injection system and the fuel quantity exiting the system by switch leakage losses, the respective pressure value present at the input of a volume flow control unit is included in the control as a further control variable.

According to a further embodiment, depending on the pressure measured at the control unit, a control unit value to be set can be identified by means of a recorded characteristic field. According to a further embodiment, the volume flow to be set can be controlled by means of a supply to the control unit depending on the pressure at the control unit.

According to another embodiment, an apparatus for the volume flow control of an injection system of an injection apparatus has a pressure measurement unit and a volume flow control unit, wherein the volume flow control is embodied as a seat valve.

BRIEF DESCRIPTION OF THE DRAWINGS

Details of the invention are described in more detail with reference to the drawings. These show.

DETAILED DESCRIPTION

The advantages achieved by means of the various embodiments consist in particular in that pressure changes acting on the stop valve are taken into consideration and this therefore enables an improved control quality of the injection system to be set.

The volume flow is determined for different pressures acting on the stop valve adjusted depending on the fuel supplied and recorded in a characteristic field.

Figure 1:
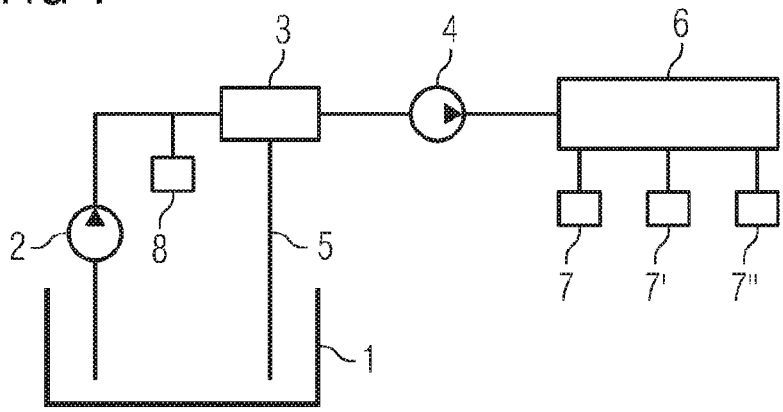
FIG. 1: a block diagram of an injection system for controlling the fuel to be injected.

FIG. 1 shows a block diagram of an injection system for controlling the fuel injection quantity. Here, the injection system consists of a low pressure pump 2 which pumps out fuel, a volume flow control valve 3 with recirculating pipe 5 to the fuel tank 1, a high-pressure pump 4 which feeds fuel to a high pressure storage unit 6, a measuring unit 8 which determines the pressure upstream of the volume flow control valve 3 and injectors 7, 7' and 7" for injecting fuel into a combustion chamber of the internal combustion engine (not shown in the drawing). It has proved to be advantageous to use a seat valve for the volume flow control valve 3.

By means of a low pressure pump 2, fuel is encouraged out of the fuel tank 1 and fed to a high pressure pump 4 via a volume flow control valve 3. The high pressure pump 4 then feeds a high pressure storage unit 6 with the fuel fed from the low pressure pump 2. In this way, pressures of up to 1800 bar can build up in the high pressure storage unit 6. Fuel is finally injected from the high pressure storage unit 6 into a combustion chamber via injectors 7, 7', and 7". The volume flow control valve 3 provided between the low pressure pump 2 and the high pressure pump 4, e.g. a seat valve serves to control the pressure inside the high pressure storage unit 6, with a recirculating pipe 5 to the fuel tank. Here, the control of the volume flow control valve 3 takes place by means of a supply of electric current to an actuator of the volume flow control valve 3, depending on the pressure measured in the measuring unit 8. With the aid of the volume flow control valve 3, the intake volume of the low pressure pump 2 is controlled and thus the pressure in the high pressure storage unit 6 is determined.

Figure 2:
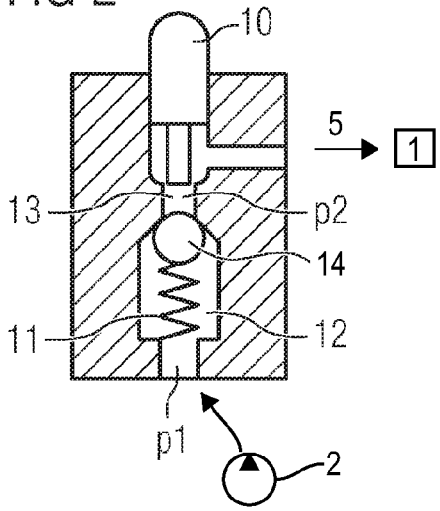
FIG. 2: a cross-sectional view of a seat valve.

FIG. 2 shows a cross-sectional view of a seat valve. A ball element 14 provided in this exemplary embodiment ensures that a volume flow through-flow between the inlet chamber 12 and the outflow chamber 13 is prevented. Fuel is fed to the intake chamber 12 from the low pressure pump 2. The fuel travels by means of the outflow chamber 13 to the fuel tank via a recirculation pipe. The ball element 14 is held in the closed position in the outgoing situation by a spring 11 so that a volume flow from the intake chamber 12 into the outflow chamber 13 is prevented. The ball element 14 can be pushed into the inlet chamber 12 by means of an actuator 10. In this way, the ball element 14 is pushed further into the intake chamber 12 the more the actuator 10 is supplied with electric current. Based on the pressure difference between the pressure p1 in the intake chamber 12 and the pressure p2 in the outflow chamber 13, the volume flow can be controlled. The volume flow is therefore greater, the further the ball element is pushed into the intake chamber 12 and/or the greater the pressure difference between the intake chamber 12 and the outflow chamber 13.

If the pressure p1 in the intake chamber 12 increases, the actuator 10 must be supplied by higher electric current in order to push the ball element 14 against the adjusting flow direction into the same position as would be the case if the pressure were not increased. In the event (not shown) that the ball element 14 is opened in the flow direction, when the pressure is increased in the intake chamber a reduced supply of electric current to the actuator will be necessary in order to push the ball element into the same position as would be the case if the pressure were not increased.

Figure 3:
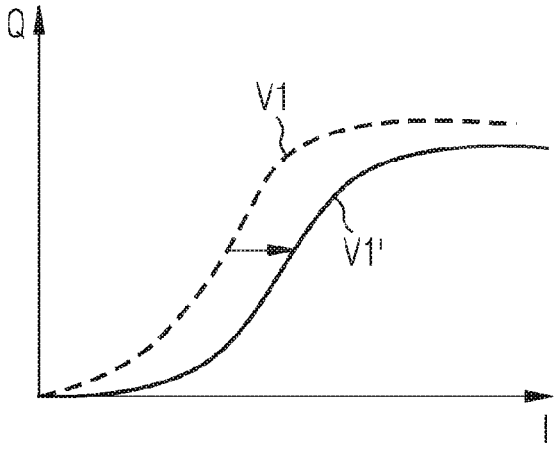
FIG. 3: the movement of a valve characteristic curve depending on the pressure acting on the stop valve.

FIG. 3 shows how a valve characteristic diagram shifts depending on the pressure acting on the stop valve. The volume flow trend Q is shown in relation to the supply of electric current I to the actuator.

The volume flow trend V1 then corresponds to the trend in a discharge pressure p1 in the intake chamber. As soon as the pressure p1 in the intake chamber increases, higher current I has to be supplied to the actuator, so that the same volume flow Q can flow via the seat valve. In this way, a new volume flow trend V1' is adjusted for a higher pressure p1 in the intake chamber.

What is claimed is:

1. A method for the volume flow control in an injection system of an injection apparatus of an internal combustion engine, comprising:

pumping fuel from a fuel tank to a high pressure storage unit using a low pressure pump and a high pressure pump, measuring a pressure value present at an upstream inlet of a volume flow control unit arranged downstream of the low pressure pump and upstream of the high pressure pump, such that the high pressure pump is arranged between the volume flow control unit and the high pressure storage unit, controlling the volume flow control unit to control a volume flow of fuel to a recirculating pipe leading back to the fuel tank, wherein the volume flow control unit comprises a ball actuated by an actuator to control the volume flow through to the recirculating pipe, wherein pressure acting on the ball from fuel upstream of the volume flow control unit influences the volume flow through the volume flow control unit, and wherein controlling the volume flow control unit comprises applying an electric current to control the actuator based at least on the measured pressure value present at the inlet of the volume flow control unit in a manner that accounts for the influence on the volume flow caused by the pressure acting on the ball from fuel upstream of the volume flow control unit.

2. The method according to claim 1, including determining a control unit value to be set from a recorded engine characteristic map based at least on the measured pressure value present at the inlet of the volume flow control unit.

3. The method according to claim 1, including determining an electric current supplied to the actuator based at least on the measured pressure value present at the inlet of the volume flow control unit.

4. An apparatus for the volume flow control of an injection system of an injection apparatus, comprising:

a low pressure pump and a high pressure pump arranged between a fuel tank and a high pressure storage unit, a volume flow control unit arranged downstream of the low pressure pump and upstream of the high pressure pump, such that the high pressure pump is arranged between the volume flow control unit and the high pressure storage unit, the volume flow control unit comprises a ball actuated by an actuator to control a volume flow to a recirculating pipe leading back to the fuel tank, wherein pressure acting on the ball from fuel upstream of the volume flow control unit influences the volume flow through the volume flow control unit, a measuring unit arranged upstream of the volume flow control unit and configured to measure a pressure value present at an upstream inlet of the volume flow control unit, and a control unit configured to apply an electric current to control the volume flow control unit to control the volume flow of fuel to the recirculating pipe by controlling the actuator based at least on the measured pressure value present at the inlet of the volume flow control unit in a manner that accounts for the influence on the volume flow caused by the pressure acting on the ball from fuel upstream of the volume flow control unit.

5. The apparatus according to claim 4, including determining a control unit value to be set from a recorded characteristic field based at least on the measured pressure value present at the inlet of the volume flow control unit.

6. The apparatus according to claim 4, including determining an electric current to supply to the actuator based at least on the measured pressure value present at the inlet of the volume flow control unit.

7. The apparatus according to claim 4, wherein the volume flow control unit is provided between a low pressure pump and a high pressure pump.

8. The apparatus according to claim 4, wherein the volume flow control unit is embodied as a seat valve comprising a ball element which ensures that a volume flow through-flow between an inlet chamber and an outflow chamber is prevented.

9. The apparatus according to claim 8, wherein the ball element is held in a closed position by a spring so that a volume flow from the intake chamber into the outflow chamber is prevented.

10. The apparatus according to claim 9, wherein the ball element is operable to be pushed into the outflow chamber by means of an actuator.

11. A method for the volume flow control in an injection system of an internal combustion engine, comprising the step of:

pumping fuel from a fuel tank to a high pressure storage unit using a low pressure pump and a high pressure pump, measuring a pressure value present at an upstream inlet of a volume flow control unit arranged downstream of the low pressure pump and upstream of the high pressure pump, such that the high pressure pump is arranged between the volume flow control unit and the high pressure storage unit, wherein pressure acting on the volume flow control unit from fuel upstream of the volume flow control unit influences the volume flow through the volume flow control unit, controlling the volume flow control unit to control a volume flow of fuel to a recirculating pipe leading back to the fuel tank, wherein controlling the volume flow control unit comprises applying an electric current to control an actuator of the volume flow control unit based at least on the measured pressure value present at the inlet of the volume flow control unit in a manner that accounts for the influence on the volume flow caused by the pressure acting on the volume flow control unit from fuel upstream of the volume flow control unit.

12. The method as claimed in claim 11, including determining a control unit value to be set is identified by means of a recorded engine characteristic map based at least on the measured pressure value present at the inlet of the volume flow control unit.

13. The method as claimed in claim 11, including determining an electric current to supply to the actuator based at least on the measured pressure value present at the inlet of the volume flow control unit.

* * * * *